US008024911B2

(12) United States Patent
Hultberg et al.

(10) Patent No.: US 8,024,911 B2
(45) Date of Patent: Sep. 27, 2011

(54) METHOD FOR BLISTER PACKING

(75) Inventors: Lennart Hultberg, Astorp (SE); Jan-Olof Olsson, Uddevalla (SE)

(73) Assignee: McNeil AB (SE)

( * ) Notice: Subject to any disclaimer, the term of this patent is extended or adjusted under 35 U.S.C. 154(b) by 560 days.

(21) Appl. No.: 11/356,644

(22) Filed: Feb. 17, 2006

(65) Prior Publication Data

US 2007/0186511 A1 Aug. 16, 2007

(30) Foreign Application Priority Data

Feb. 16, 2006 (SE) ..... 0600342

(51) Int. Cl.
*B65B 61/02* (2006.01)

(52) U.S. Cl. ..... 53/411; 53/453; 53/454; 53/559

(58) Field of Classification Search ..... 53/411, 53/453, 454, 432, 560, 561, 578, 324, 298, 53/559

See application file for complete search history.

(56) References Cited

U.S. PATENT DOCUMENTS

| | | | | |
|---|---|---|---|---|
| 3,903,773 A | | 9/1975 | Furukawa | |
| 4,506,495 A | * | 3/1985 | Romagnoli | 53/559 |
| 4,571,924 A | * | 2/1986 | Bahrani | 53/453 |
| 4,750,318 A | * | 6/1988 | Matsuzawa | 53/559 |
| 5,105,603 A | * | 4/1992 | Natterer | 53/412 |
| 5,192,484 A | * | 3/1993 | Matuzawa et al. | 264/555 |
| 5,600,939 A | * | 2/1997 | Giovannone | 53/559 |
| 5,799,468 A | * | 9/1998 | Eck et al. | 53/453 |
| 6,334,290 B1 | * | 1/2002 | Reichert et al. | 53/559 |
| 6,470,650 B1 | * | 10/2002 | Lohwasser | 53/453 |
| 6,843,038 B1 | * | 1/2005 | Haws | 53/133.4 |
| 6,871,477 B1 | * | 3/2005 | Tucker | 53/433 |
| 6,941,729 B2 | * | 9/2005 | Dal Pozzo | 53/453 |
| 7,055,294 B1 | * | 6/2006 | Lewis | 53/411 |

FOREIGN PATENT DOCUMENTS

| | | |
|---|---|---|
| DE | 1974838 | 12/1967 |
| DE | 1942718 | 4/1971 |
| DE | 2637519 | 2/1978 |
| EP | 0806359 | 1/1997 |
| EP | 1153836 | 11/2001 |
| GB | 967729 | 12/1960 |
| GB | 1286917 | 8/1972 |
| GB | 2212472 | 7/1989 |
| GB | 2295820 | 6/1996 |
| JP | 56014505 | 7/1979 |
| JP | 2002173173 | 6/2002 |
| JP | 2003104329 | 4/2003 |
| RU | 2215656 | 11/2003 |
| SE | 512 896 | 5/2000 |
| WO | 0194213 | 12/2001 |
| WO | 02/12066 | 2/2002 |
| WO | WO02/102357 | 12/2002 |

* cited by examiner

*Primary Examiner* — Sameh H. Tawfik
(74) *Attorney, Agent, or Firm* — Karen G. Horowitz

(57) ABSTRACT

The invention relates to a method for blister packing products (9), comprising the step of packaging said products (9) in a blister web (1) or a blister sheet (2) and storing said blister web or blister sheet intermediately (12). Following said intermediate storing (12) several blister packs (4) are formed from said blister web (1) or blister sheet (2).

20 Claims, 4 Drawing Sheets

METHOD FOR BLISTER PACKING

FIELD OF THE INVENTION

The present invention relates to a method for blister packing products.

BACKGROUND OF THE INVENTION

It is well known to pack products, by way of example tablets, capsules, chewing gums, medical devices, spare parts etc in blister packs. The blister pack can in each blister contain one single product as well as a number of products.

A typical blister pack comprises one single or an array of cavities covered by a film to form blisters. The pack is opened by pressing the blister, whereby the film breaks and exposes the product contained therein, or by peeling off the film. For pharmaceutical preparations, the customer is normally provided with a packet comprising a number of blister packs, each containing a number of tablets/capsules in individual blisters.

The products to be packed are normally provided loose in large batches in the form of bags or boxes. This type of bulk storage is however less favourable in the case of products which are pressure sensitive or which have a low abrasion resistance, since the products will press and rub against each other during handling. This often results in a need of quality control before packaging and also large cassations. Further, bulk storage is also less favourable in view of shelf life since it is hard to control the environmental conditions. Accordingly, it is favourable to minimize the handling in bulk and also minimize the time from production of the products to packaging. Thus, sensitive products should preferably be packed in blister packs as soon as possible after production.

Blister packs and blister packages containing blister packs are generally formed in continuous lines, wherein a continuous web of a carrier material is fed, and during which feeding a number of cavities are formed by way of example pressing, vacuum forming or film blowing. The cavities are filled with a desired amount of products from a batch, where after the cavities are covered by a continuous film, which is pressed and fixed to the carrier material, to form a continuous blister web. The continuous film is normally fixed to the carrier material by adhesive bonding or heat sealing. The film or the carrier material can be pre-printed with desired information or the film or carrier material can be provided with a print after forming said continuous blister web. Finally, the continuous blister web is cut to form individual blister packs with arrays of a desired amount of blisters. The resulting skeleton of waste material is coiled for further destruction or recycling.

For some applications, by way of example for pharmaceutical preparations, the above described continuous line is further provided with the additional step of providing the desired numbers of blister packs into a packet together with a packaging slip such as an insert in the form of a leaflet or booklet, a coupon or other types of information or marketing material, before palletizing the packets. Due to rigorous requirements in the pharmaceutical industry, this step is integrated in the above disclosed continuous line.

This type of continuous lines have a drawback of low efficiency if the packets are produced for different clients or are to be used in different countries, since each client or country normally requires its own specific print, number of blister packs per packet, type of pack or packet, pack or packet design and packaging slip. Accordingly, the downtime for change of settings and materials is high, which in the end affects the total cost. Also, continuous lines are sensitive for frequent starts and stops. Further, each continuous line is normally used for one type of product, whereby a production facility producing a number of different products normally requires a corresponding number of different lines running in parallel.

From SE 512 896 a method and system for packaging pharmaceutical preparations is known. It discloses a method and system in which blister packs are formed and stored in intermediate storing containers. The intermediate storing containers can be transported to a final packaging facility, which facility can be on another site, where the blister packs are marked and put in packets in accordance with the specific requirements of a client. The intermediate storing containers are in the form of tubes or similar, containing stacked blister packs. This method and system does however involve a problem in that the continuous lines producing the individual blister packs still must be adapted to or be set to produce blister packs having a specific size and a specific array of blisters. The versatility of the continuous line is thus still restricted.

Also, in order to meet a short delivery time the producer must keep storage in the form of intermediate storing containers which are specific for one design of a blister pack, such as a square blister pack having an array of ten blisters and a specific print. The latter is normally necessary since printing on individual packs requires a very high production speed and thereby a more complicated machinery.

Thus, there is a need for a method with improved versatility of producing blister packs and packets, and which method allows for short delivery time but still allows for a customer specific design of the blister packs and packets.

OBJECTS OF THE PRESENT INVENTION

Thus, one object of the present invention is to provide a method of producing blister packs, which method provides a good versatility regarding form and design of blister packs and thus client specific packs.

A second object of the present invention is to provide a method which allows for a minimized client designed stock-keeping, but that still allows for short delivery times.

Yet another object is to provide a method which allows an enhanced shelf life of the products.

SUMMARY OF THE INVENTION

To achieve at least one of the above objects, and also other objects that will appear from the following description, the present invention relates to a method for blister packing products, characterized in the steps of packaging said products in a blister web or a blister sheet, intermediate storing of said blister web or blister sheet, and following said intermediate storing forming several blister packs from said blister web or blister sheet.

With the term "blister web" is meant a blister-containing band, which may be cut into more than one final size blister pack.

With the term "blister sheet" is meant a blister-containing sheet, which may be cut into more than one final size blister pack.

With the term "intermediate storing" is meant a time-range that can vary from minutes up to several months, depending on e.g. the type of products.

The method of the present invention allows for lean manufacturing in terms of a minimized client designed stock-keeping since the intermediate storing is made in blister webs or blister sheets, whereby you need not stock as many final size blister packs as when bulk storage is made in bags or boxes. Said webs or sheets can be neutral, i.e. without printing. Once a client puts an order, a required amount of blister web or blister sheets can be provided from the intermediate storage, after which the requested amount of blister packs with the requested form and design of the blister pack can be provided from said blister web or blister sheet. The client has the options of having blister packs with an array of blisters arranged in, for example, two rows with five blisters each (a rectangular blister pack) or three rows with three blisters each (a quadrangular blister pack). Thus, the degree of versatility is high. Any left over items remaining from the blister web or blister sheet can be returned to the intermediate storage to be used for a subsequent client having its specific requirements. Also, once the order has been placed, the blister web or blister sheet or the individual blister packs can be provided with the requested client specific information. In spite of the high degree of versatility, the method still allows for short delivery times. In some cases the delivery time can even be shortened in comparison with hitherto used blister packing methods.

The method of the present invention further allows for shorter cycle time with the same amount of production since during each cycle, by way of one stroke by a cutter producing blister packs from said web or sheet, multiple blister packs are formed. A reduced cycle time allows for a cheaper machinery and also higher access to the machinery.

Under the circumstance that the blister packing is made in connection with production of products, the method allows an enhanced shelf life of the product since the storing of the product is performed in the well controlled environment provided in each blister instead of in batches in form of by way of example bags or boxes. Storing of products in such batches affects the total shelf life also once the product has been put into a blister pack since the total shelf life needed must be decided upon bases on an estimation of the deterioration time of the product during batch storage. If the product is packed into a blister in connection with production such estimation can be eliminated and thus the total shelf life enhanced.

A particular advantage of the invention is that cassation of products can be reduced since once the product has been put into a blister it is protected from the pressure and abrasion that it is normally subjected to during intermediate storing in batches.

Another advantage of the present invention is that the amount of waste material can be reduced to a minimum or even be eliminated.

A third advantage is that the number of lines per production facility normally required due to the rigorous requirements in the pharmaceutical industry can be reduced since the step of packing products in blister webs or blister sheet is separated from the step of forming blister packs. Further, the invention allows for reduced downtime for change of settings and material.

Said blister web or blister sheet can have a width and length comprising more than one blister, whereby more than one blister pack can be formed in the width and length direction of said blister web or blister sheet.

The blister sheet can be formed from a continuous blister web.

The method can include the step of printing said blister web or blister sheet with client specific information before or after forming said several blister packs. This allows for a good versatility since the intermediate storing can be made without any client specific information. Although the printing can be made before as well as after forming blister packs, it is preferred that the printing is made before since this allows for higher production speed and less complicated machinery. Both factors are of economical importance.

The method allows for each blister pack to be formed based on client specific requirements in view of arrays of blisters and the size and form of the blister pack. This allows for a very good versatility since once an order is put, a sufficient amount of pre-produced blister sheets or webs to cover the order can be requested from the intermediate storage. The blister web or blister sheet can be used no matter if the client requests e g blister packs with arrays of two rows with five blisters each or three rows with three blisters each. In fact, there are no restrictions in view of size or geometry of the blister pack as long as it is accommodated within the boundaries of the blister web or blister sheet. Any remains of the web or sheet after the order has been filled can be returned to the intermediate storage to be used for another order from another client based on his specific requirements.

The method can comprise the additional step of arranging said blister packs in packets wherein each packet contains at least one blister pack. This additional step can be made upon client specific requirements, in another continuous line, and also at another facility. Since the products are already provided in a well controlled environment in the blisters, the requirements for the environment, machinery and personnel used for this purpose can be less strict. Normally, the pharmaceutical industry requires the production and packing of products to be made in a clean area environment. Since the present invention allows for the step of packaging products in blister packs to be separated from the step of packaging blister packs in packets and especially to be made in a different line or at another facility, the environmental requirements for such later steps can be less strict. This allows for a lower production cost.

Said step of arranging blister packs in packets can include putting a packing slip in each packet. The term packing slip is meant to include an insert in the form of a leaflet or booklet, a coupon or other types of information or marketing material. Also accessories can be put into the packet.

Said blister web can be intermediately stored in a fan folded or coiled condition, or alternatively intermediately stored in a stacked, standing or hanging position.

The packaging of products in said blister web or blister sheet can be made in direct connection with production of said products. This allows for an enhanced shelf life since the individual blister provides a better controlled and more protecting environment than hitherto used bags and boxes for intermediate storage.

The step of packaging products in said blister web or blister sheet can include supplying protective gas to each blister for the provision of a preventive atmosphere therein. This further provides for enhanced shelf life. As an alternative a protective liquid or a semisolid can be supplied to each blister for the provision of a preventive environment therein.

Further, said blister web or blister sheet comprises an insert having preformed cavities forming part of said blister web or blister sheet. This allows for the packing of products to be separated from the line in which the blister web or blister sheet is produced. The cavities of the insert can be pre-filled with products and also be covered by a film.

Said products can be packed in a blister web or a blister sheet by moulding, whereby the products are poured in liquid form into the blisters, where they are allowed to solidify to their final shape. An example of this technology may be seen in DE 26 37 519.

Said product may be a pharmaceutical product. Preferably said product is a nicotine replacement product.

BRIEF DESCRIPTION OF DRAWINGS

The invention will now be described in more detail by way of example and with reference to the accompanying drawings.

DETAILED DESCRIPTION OF THE DRAWINGS

The inventive method relates to packing products in blister packs, especially products requiring rigorous quality control such as pharmaceutical products, preferably nicotine replacement products, and most preferably nicotine-containing oral dosage forms, e g gums, lozenges and tablets.

Materials known in the art may be used for the claimed invention. For blister packing of nicotine-containing products especially useful is a copolymer of acrylonitrile and methyl acrylate known under the trade name Barex®. This copolymer is a good barrier for inter alia nicotine and oxygen. See e g U.S. Pat. No. 5,400,808.

Figure 1:
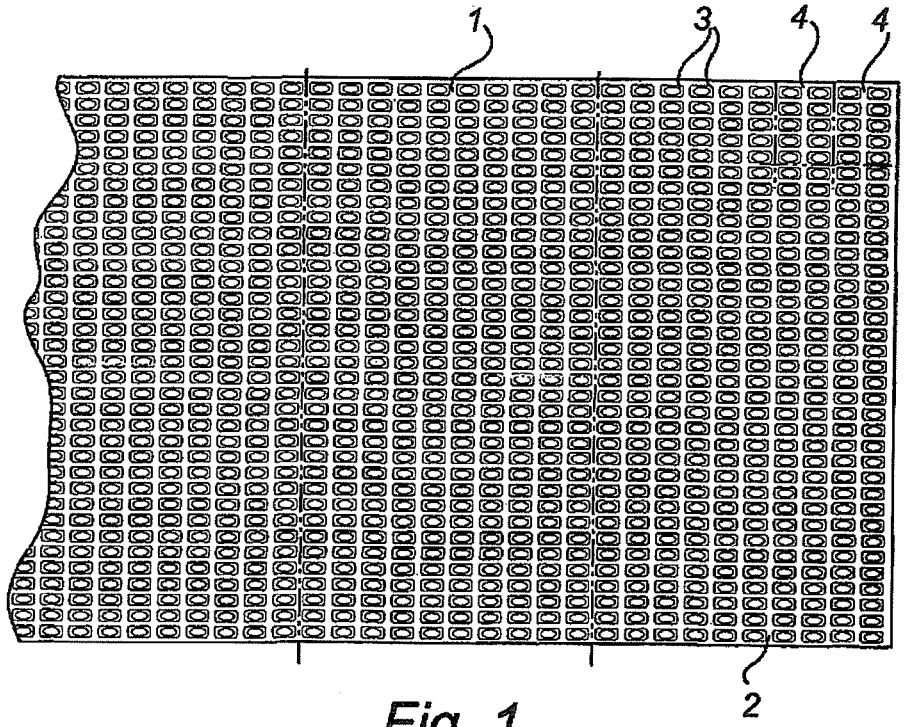
FIG. 1 illustrates a blister web and a blister sheet in accordance with the present invention.

FIG. 1 discloses a blister web 1 and blister sheet 2 formed from said web. The blister web 1 and blister sheet 2 comprise a large amount of blisters 3, each containing one or several products. The blisters 3 are in the shown embodiment arranged in rows, each row comprising more than one blister. From this blister web 1 or blister sheet 2, blister packs 4 can be cut based on client specific orders, in view of size and form of each blister pack and number of blisters in each blister pack.

Figure 2:
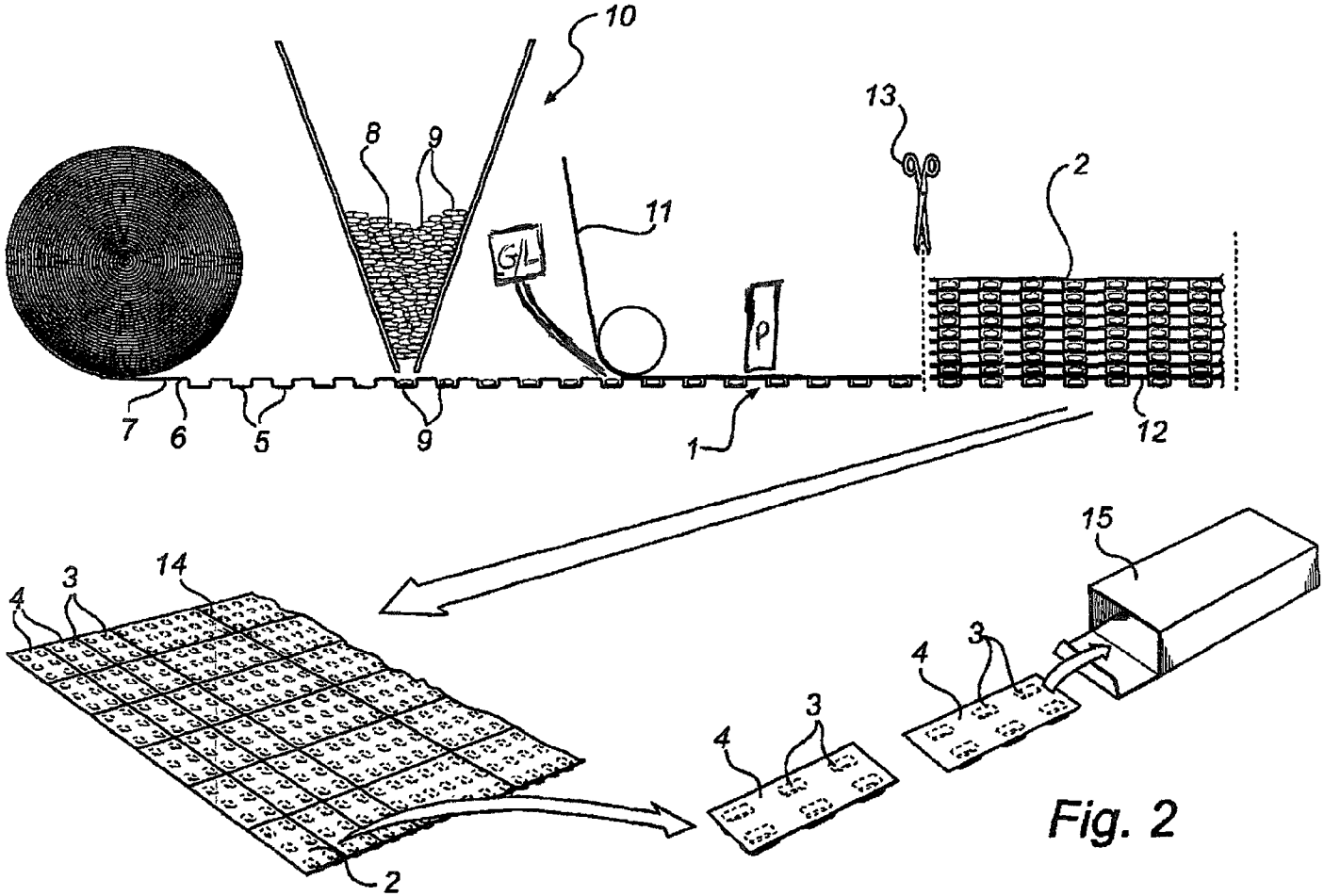
FIG. 2 schematically illustrates the steps in producing a blister pack in accordance with the present invention.
Figure 3:
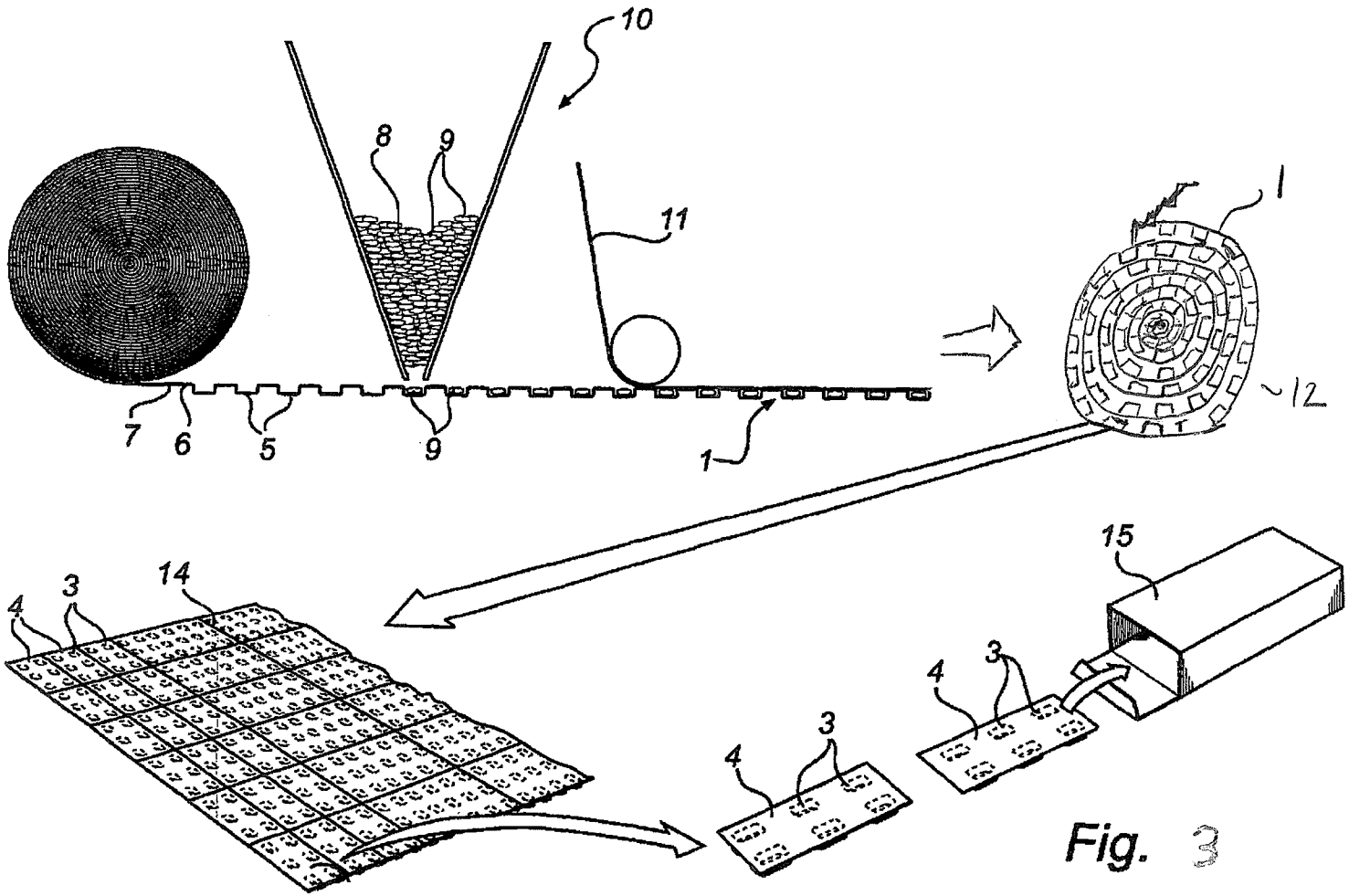
FIG. 3 schematically illustrates the steps in producing a blister pack in accordance with the present invention, similar to the steps illustrated in FIG. 2, but with a different manner of storing the blister web.
Figure 4:
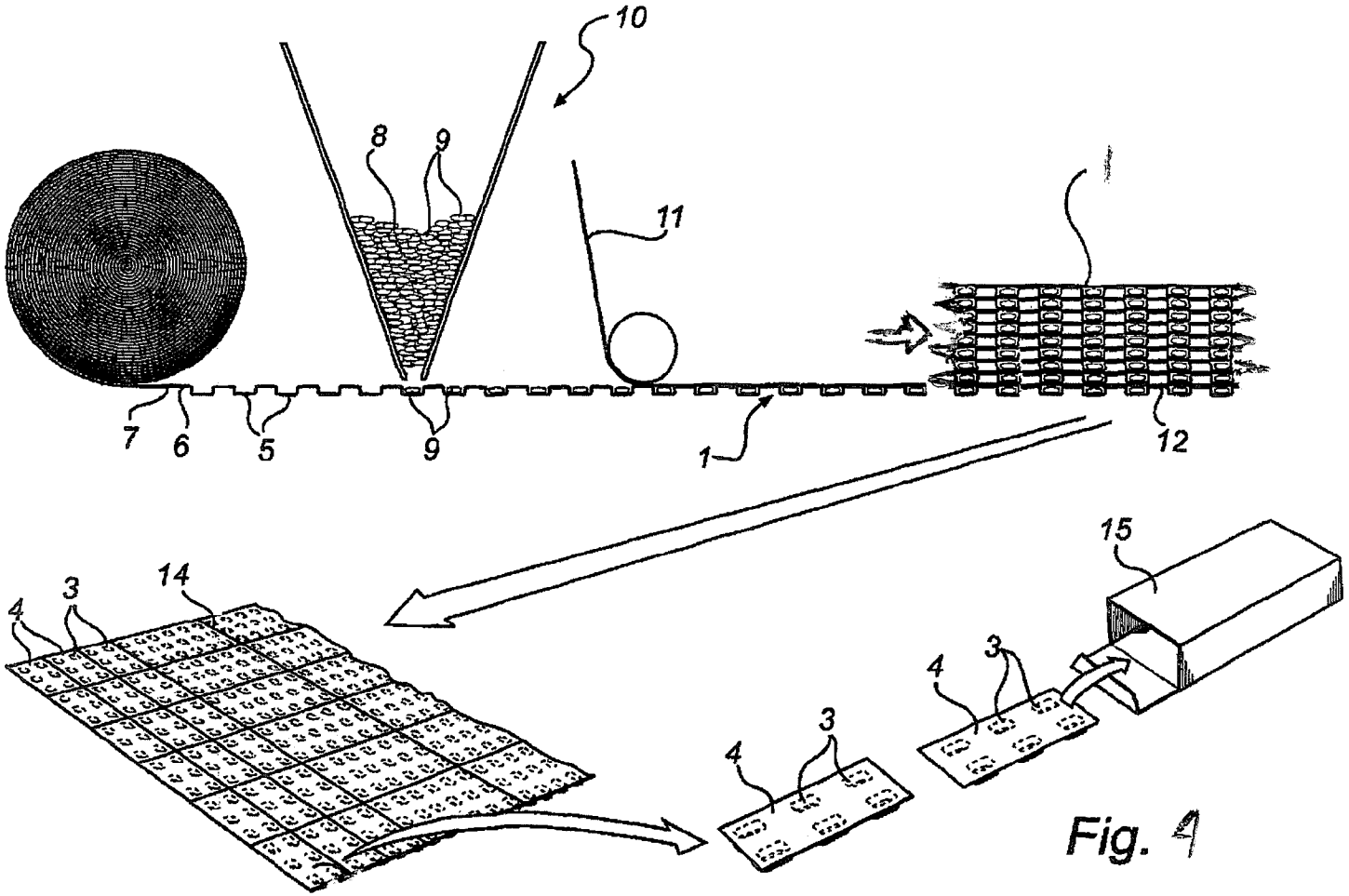
FIG. 4 schematically illustrates the steps in producing a blister pack in accordance with the present invention, similar to the steps illustrated in FIG. 2, but with a different manner of storing the blister web.

FIGS. 2-4 disclose a schematic process flow of the inventive method for packaging products. The following disclosure will be based on a blister web.

The products are produced in a known manner with or without an intermediate step of coating. Coating can be made to form by way of example a protection, a cover, a taste, a colour or a marking on the product. Examples of coated products may be seen in e g WO 02/102357.

The resulting products are provided in batches 8 loose in bags or boxes to the continuous line 10 producing a blister web 1 or blister sheets 2.

A blister web 1 is formed in a known manner by forming a number of cavities 5 by way of example pressing, vacuum forming or film blowing during feeding of a continuous web 7 of a carrier material 6. The continuous web 7 has a width, i.e. perpendicular to the feeding direction, containing at least one cavity 5. Preferably, the continuous web 7 has a width adapted so that more than one blister pack 4, each comprising more than blister 3, can be formed along said width.

The cavities 5 are filled with a desired amount of products 9 from the batch 8. In the case of pharmaceutical products, normally one piece is put in each cavity. However several products of one and the same type, or different types, can be put in the individual cavities. Before being put into cavities the products can pass a quality control (not shown) for cassation of defect products.

After filling, the cavities 5 are covered by one or more continuous films 11 which are pressed and fixed to the continuous web 7 to form the continuous blister web 1. The continuous film 11 is preferably fixed to the carrier material 6 by adhesive bonding or heat sealing or a combination thereof. The term heat sealing is meant to include welding methods such as thermal welding, ultra sound welding or induction welding. A principal use of the previous technology as such may be seen in e g SE 512 896.

The continuous film 11 can be pre-printed with desired information or the film can be provided with a print (such as by print-head P illustrated schematically in FIG. 2) after being applied to the continuous web 7 of carrier material 6. It is to be understood that the carrier material 6 as well can be provided with a print before or after forming cavities 5.

When there is no need to make the opening of the blister pack 4 child-resistant it is preferable to use just have one film 11. One way of making the opening of the blister pack 4 child-resistant is though to use at least two films 11, an upper film 11A being resistant against tearing and a lower film 11B providing a barrier against e g migration of oxygen. You cannot open such a child-resistant blister pack 4 by pressing the product 9 through the films 11. You need first tear off the upper film 11A and then press the product 9 through the lower film 11B.

In order to increase flexibility the blister web 1 is sealed with just one lower film 11A, whereby the filled blister web 1 will not be child-resistant. If needed, then just before the cutting of the blister webs 1 into blister packs 4 an additional tear-resistant upper film 11B is adhered to the lower film 11A. Thereby the lower film 11A may be printed with information suited for a market not requiring child-resistant blister packs 4, while the upper film 11B may be printed with information suited for a market that requires child-resistant blister packs 4. Further, the upper film 11 B may be transparent, whereby the information on both lower film 11A and on upper film 11B is accessible to the patient.

The formation of the blister web 1 is preferably made in direct connection to the production of the product and as part of the manufacturing process so that no intermediate storage is needed. However, a buffer of the products is normally required, which buffer can be equaled with the above discussed batch 8. The sooner the product is packed into a blister, the longer shelf life can be achieved since the individual blister provides a well controlled environment. In case of further enhanced shelf life the blister can be provided with a protective gas such as carbon dioxide, argon or nitrogen to provide preventive atmosphere therein. It is to be understood that enhanced shelf life also can be achieved by adding a protective liquid, such as a salt solution, e.g., NaCl or KCl, or a semisolid. Provision of a protective gas or liquid is illustrated schematically by G/L in FIG. 2.

The thus formed continuous blister web 1 can either be coiled (as illustrated in FIG. 3) or fan folded (as illustrated in FIG. 4) for intermediate storing 12, or be cut 13 across the width (as shown in FIG. 2) into a number of blister sheets 2 for intermediate storing 12. Depending on the width of the blister web 1, more than one blister sheet 2 can be formed across the width. In the case of blister sheets 2, these are preferably stored in a stacked, standing or hanging condition, depending on the size of the sheet.

The description of the previous paragraph is based on the carrier material being provided as a continuous band. The above description is applicable mutatis mutandis for a carrier material being provided in sheets.

The above disclosed blister web 1 or blister sheet 2 provides a very good versatility since it is not limited to requirements of a specific client other than the specific product contained in the blister. Once a client places an order for a specific type of blister pack, by way of example a blister pack having an array of ten blisters provided in two rows with five blisters each, where the blister pack has a print in English on the film, the producer can initially calculate the required amount of blister web or blister sheet to cover the order. The necessary amount of blister web 1 or blister sheet 2 is then requested from the intermediate storage 12. Thereafter the blister web 1 or blister sheet 2 is provided with the required print (not shown) and then cut 14 into a sufficient number of blister packs 4 having the specific array of blisters 3 to cover the order. If the client requests a specific print this printing is preferably made before cutting since this allows for a reduced cycle time during the printing, which in turn provides for less expensive machinery. Also, during cutting or before cutting, the blister sheet or blister web can be provided with any tear initiations or perforations.

The production of client specific blister packs 4 is preferably made in direct connection with the step of putting the blister packs 4 in packets 15 together with any packaging slips, since the packets as well as packaging slips normally are client specific and/or specific for a certain country. The term packing slip is to include inserts such as booklets, leaflets, information folders and other enclosed material. Also accessories can be put into the packet. Putting blister packs 4 in packets 15 together with packaging slips and other items is well known prior art and is not further disclosed.

Instead of packing said blister packs 4 in packets 15, other types of containers and dispensers can be used. It is also to be understood that the blister packs can be provided loose to the customer, wherein the blister pack as such provides the final package.

Further, it is to be understood that the film 11 covering the filled cavities 5 to form blisters 3 can be provided with means making the opening of the blister packs child proof. Such child proofing can by way of example be in the form of dual films wherein one must be peeled off and one pressed to get access to the product. The outer film of such dual films can be applied afterwards in connection with the client specific order.

Figure 5:
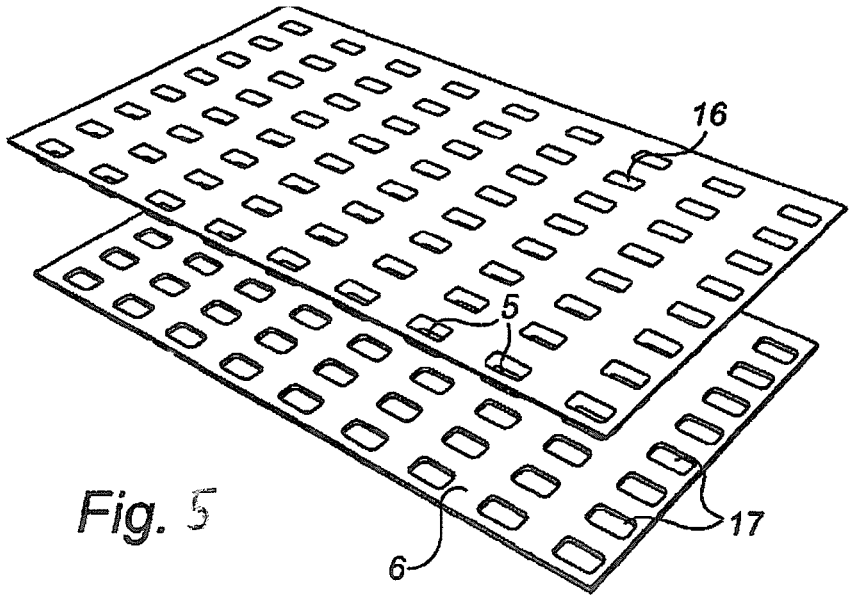
FIG. 5 discloses an alternative method for producing a blister sheet.

With reference to FIG. 5, an alternative method of producing said blister web 1 or blister sheet 2 is disclosed. Instead of forming cavities 5 in the carrier material 6 by using by way of example pressing, vacuum forming or film blowing, the carrier material 6 can be provided with inserts 16 with preformed cavities 5'. In that case the carrier material 6, being a continuous web or a sheet, is preferably provided with holes 17 for receiving the cavities 5', after which the insert 16 and carrier material 6 are joined. The cavities 5' of the insert 16 can be pre-filled with products before being joined with the carrier material 6. Such pre-filled insert can also be covered by a film before being joined with the carrier material. Also, the material in the insert can be different to that in the carrier.

Further, the disclosure above has been based on the provision of loose products. The product can also be moulded direct into the cavity.

It will be appreciated that the present invention is not limited to the shown and described embodiment of the invention. Several modifications and variants are thus conceivable, and consequently the invention is defined exclusively by the appended claims.

The invention claimed is:

1. Method for custom blister packing products in customized blister packs comprising a plurality of blisters arranged in accordance with customer requests, said method comprising:

forming a blister web or a blister sheet comprising a plurality of rows of blisters, each row made up of more than one blister, said blister web or blister sheet having more blisters than desired by customers in a finished blister pack such that said blister web or blister sheet is configured for storage in a configuration not conforming to the final size of a blister pack for distribution to a consumer before receiving a customer request with regard to a desired number of rows of blisters and number of blisters per row to be contained in a customized blister pack to be formed from said blister web or blister sheet for distribution to a consumer;

filling each of said blisters with at least one of said products and sealing said products in said blisters;

after filling and sealing said blisters, intermediate storing of said blister web or blister sheet;

waiting to receive a customer request with regard to number of rows of blisters and blisters per row to be contained in a customized blister pack to be formed from said blister web or blister sheet that is in intermediate storage; and upon receipt of said customer request, removing said blister web or blister sheet from intermediate storage;

custom cutting said blister web or blister sheet that has been removed from intermediate storage to contain the number of rows of blisters and number of blisters per row according to said customer request to form from said blister web or blister sheet more than one customized blister pack having a predetermined number of blisters in each customized blister pack according to said customer request, said predetermined number being smaller than the number of blisters in said blister web or blister sheet while in storage;

intermediate storing of any portion of said blister web or blister sheet remaining after cutting a customized blister pack therefrom for later custom forming of at least one additional customized blister pack therefrom;

wherein:

said customized blister pack has at least one blister containing at least one product for distribution to a consumer, and has fewer blisters than in the blister web or blister sheet that has been removed from intermediate storage and from which said customized blister pack has been cut; and said intermediate storing of said blister web or blister sheet is chronologically separate from and occurs before said custom cutting of said blister web or blister sheet into customized blister packs such that said custom cutting of customized blister packs is not performed sequentially after said packaging of said products in blisters.

2. Method according to claim 1, wherein said blister web or blister sheet has a width and length comprising more than one blister, said method further comprising cutting more than one customized blister pack from said blister web or blister sheet that has been removed from intermediate storage in the width and length direction of said blister web or blister sheet that has been removed from intermediate storage.

3. Method according to claim 1, wherein said blister sheet is formed from a continuous blister web.

4. Method according to claim 1, further including printing said blister web or blister sheet with client specific information after removal of said blister web or blister sheet from intermediate storage, after receipt of a customer request with regard number of blisters to be contained in said customized blister pack, and before or after forming said several customized blister packs from said blister web or blister sheet that has been removed from intermediate storage.

5. Method according to claim 1, wherein each customized blister pack is formed based on client specific requirements in view of arrays of blisters and the number of blisters in each row of blisters in the customized blister pack.

6. Method according to claim 1, further comprising arranging said customized blister packs in packets, wherein each packet contains at least one customized blister pack.

7. Method according to claim 1, further comprising packing at least one customized blister pack in a container or dispenser for distribution to a consumer.

8. Method according to claim 7, further comprising putting a packaging slip in each container or dispenser, wherein said custom cutting of said blister web or blister sheet that has been removed from storage is performed in direct connection with arranging said customized blister packs in packets together with a packaging slip.

9. Method according to claim 1, wherein said blister web is intermediately stored in a fan folded or coiled condition.

10. Method according to claim 1, wherein said blister sheet is intermediately stored in stacked, standing, or hanging position.

11. Method according to claim 6, wherein:

said packaging of products in said blister web or blister sheet is made in direct connection with production of said products; and said custom cutting of said blister web or blister sheet that has been removed from storage is performed in direct connection with arranging said customized blister packs in packets and at a different time from when said production of products and packaging of products is performed.

12. Method according to claim 1, wherein packaging products in said blister web or blister sheet includes supplying protective gas to each blister for the provision of a preventive atmosphere therein.

13. Method according to claim 1, wherein packaging products in said blister web or blister sheet includes supplying protective liquid or a semi-solid to each blister for the provision of a preventive environment therein.

14. Method according to claim 1, wherein said blister web (1) or blister sheet (2) comprises an insert (16) having preformed cavities (5) forming part of said blister web (1) or blister sheet (2).

15. Method according to any of the preceding claims, wherein said at least one product is a pharmaceutical product.

16. Method according to claim 15, wherein said at least one product is a nicotine-containing product.

17. Method according to claim 16, wherein said at least one product is a chewing gum, a lozenge or a tablet.

18. Method according to claim 16 or 17, wherein said blister comprises a material acting as a barrier for nicotine and oxygen, preferably a copolymer of acrylonitrile and methyl acrylate.

19. Method according to claim 1, wherein said custom cutting of said blister web or blister sheet is performed in direct connection with packing at least one blister pack in a packet for distribution to a consumer, said blister packs only being formed upon receipt of a customer request with regard to number of blisters to be contained in a customized blister packet.

20. Method according to claim 1, further including printing client specific information on said blister web or blister sheet after removal of said blister web or blister sheet from intermediate storage and before custom cutting said blister web or blister sheet into customized blister packs.

* * * * *